US006902233B2

(12) United States Patent
Tseng

(10) Patent No.: US 6,902,233 B2
(45) Date of Patent: Jun. 7, 2005

(54) RECLINING CHAIR WITH EXTENDIBLE LEG REST

(75) Inventor: Chuen-Jong Tseng, Chiayi Hsien (TW)

(73) Assignee: Taiwan Shin Yeh Enterprise Co., Ltd., Chiayi Hsien (TW)

( * ) Notice: Subject to any disclaimer, the term of this patent is extended or adjusted under 35 U.S.C. 154(b) by 0 days.

(21) Appl. No.: 10/630,140

(22) Filed: Jul. 30, 2003

(65) Prior Publication Data

US 2005/0035632 A1 Feb. 17, 2005

(51) Int. Cl.[7] ..... A47C 1/02
(52) U.S. Cl. ..... 297/85; 297/83
(58) Field of Search ..... 297/83–85

(56) References Cited

U.S. PATENT DOCUMENTS 3,433,527 A * 3/1969 Re ..... 297/85
3,558,185 A * 1/1971 Mizelle ..... 297/84
3,572,823 A * 3/1971 Hampton ..... 297/85
3,743,348 A * 7/1973 Sloan ..... 297/85
4,216,991 A * 8/1980 Holobaugh ..... 297/85
4,544,201 A * 10/1985 Rogers, Jr. ..... 297/259.2
4,863,215 A * 9/1989 Crum ..... 297/85
5,810,431 A * 9/1998 Gibson ..... 297/85
5,823,614 A * 10/1998 Johnson et al. ..... 297/85
6,135,559 A * 10/2000 Kowalski ..... 297/354.12
6,142,558 A * 11/2000 May ..... 297/75
6,557,934 B2 * 5/2003 Wiecek ..... 297/84

* cited by examiner

*Primary Examiner*—Peter M. Cuomo
*Assistant Examiner*—Stephen D'Adamo
(74) *Attorney, Agent, or Firm*—Ladas & Parry LLP

(57) ABSTRACT

A reclining chair includes a base frame, a pivot link having a lower pivot end connected pivotally to the base frame, a back frame, and a carriage. A linkage mechanism couples pivotally a lower end of the back frame to a rear end of the carriage and to an upper pivot end of the pivot link, thereby permitting movement of the back frame from an upright position to a tilted position relative to the carriage in response to pressure applied on the back frame, and thereby permitting movement of the carriage between front and rear carriage positions relative to the base frame. A leg rest assembly is connected pivotally to the front end of the carriage and the base frame, and is driven by the carriage to an extended position during movement of the carriage to the rear carriage position.

9 Claims, 8 Drawing Sheets

RECLINING CHAIR WITH EXTENDIBLE LEG REST

BACKGROUND OF THE INVENTION

1. Field of the Invention

The invention relates to a reclining chair, more particularly to a reclining chair that does not require a lever mechanism for tilting a back frame and for extending a leg rest assembly.

2. Description of the Related Art

Referring to FIGS. 1 and 2, a conventional reclining chair is shown to include a seat portion 11, a back portion 12, and a leg rest 13. A lever mechanism 14 is operated to control tilting of the back portion 12 and extension of the leg rest 13.

The conventional reclining chair is disadvantageous in that a relatively large amount of force has to be exerted when operating the lever mechanism 14 in view of the weights of the back portion 12 and the leg rest 13. Moreover, since the lever mechanism 14 is generally disposed at a lower lateral side of the seat portion 11, it is not convenient for a person seated on the reclining chair to reach and operate the lever mechanism 14.

SUMMARY OF THE INVENTION

Therefore, the object of the present invention is to provide a reclining chair that does not require a lever mechanism for tilting a back frame and for extending a leg rest assembly.

According to the present invention, a reclining chair comprises: a base frame; a pivot link having a lower pivot end connected pivotally to the base frame, and an upper pivot end; a back frame having a lower end; a carriage having front and rear ends; a linkage mechanism for coupling pivotally the lower end of the back frame to the rear end of the carriage and the upper pivot end of the pivot link, thereby permitting movement of the back frame from an upright position to a tilted position relative to the carriage in response to pressure applied on the back frame, and thereby permitting movement of the carriage between front and rear carriage positions relative to the base frame; a leg rest assembly connected pivotally to the front end of the carriage and the base frame and driven by the carriage to move from a retracted position to an extended position during movement of the carriage from the front carriage position to the rear carriage position; and stop means provided on the linkage mechanism and the rear end of the carriage for positioning the back frame at the tilted position.

When the back frame is at the tilted position, movement of the carriage from the front carriage position to the rear carriage position due to an external applied force results in movement of the leg rest assembly from the retracted position to the extended position and simultaneously results in rearward pivoting movement of the back frame, the linkage mechanism, the carriage and the pivot link relative to the base frame.

BRIEF DESCRIPTION OF THE DRAWINGS

Other features and advantages of the present invention will become apparent in the following detailed description of the preferred embodiment with reference to the accompanying drawings, of which.

DETAILED DESCRIPTION OF THE PREFERRED EMBODIMENT

Figure 1:
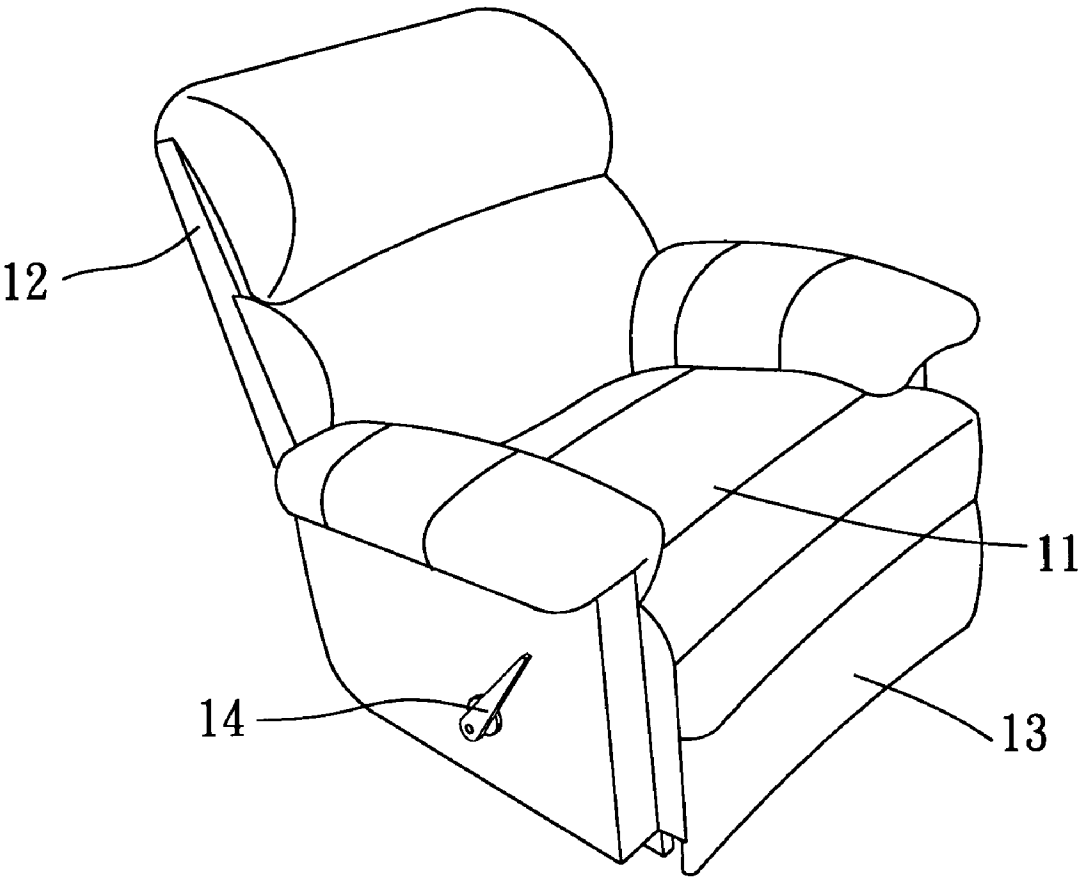
FIG. 1 PRIOR ART
FIG. 1 is a perspective view to illustrate a conventional reclining chair in a normal state.
Figure 2:
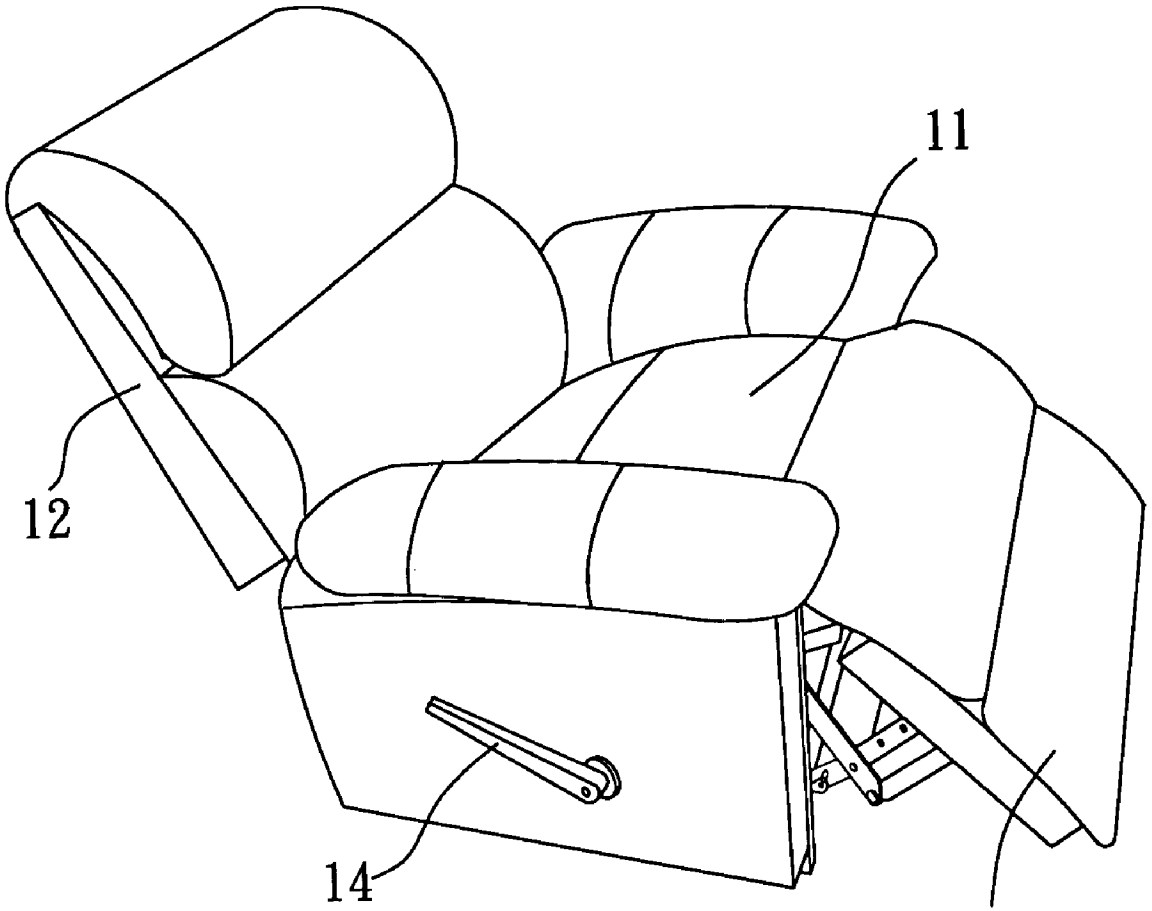
FIG. 2 PRIOR ART
FIG. 2 is a perspective view to illustrate the conventional reclining chair of FIG. 1 in a reclining state.
Figure 3:
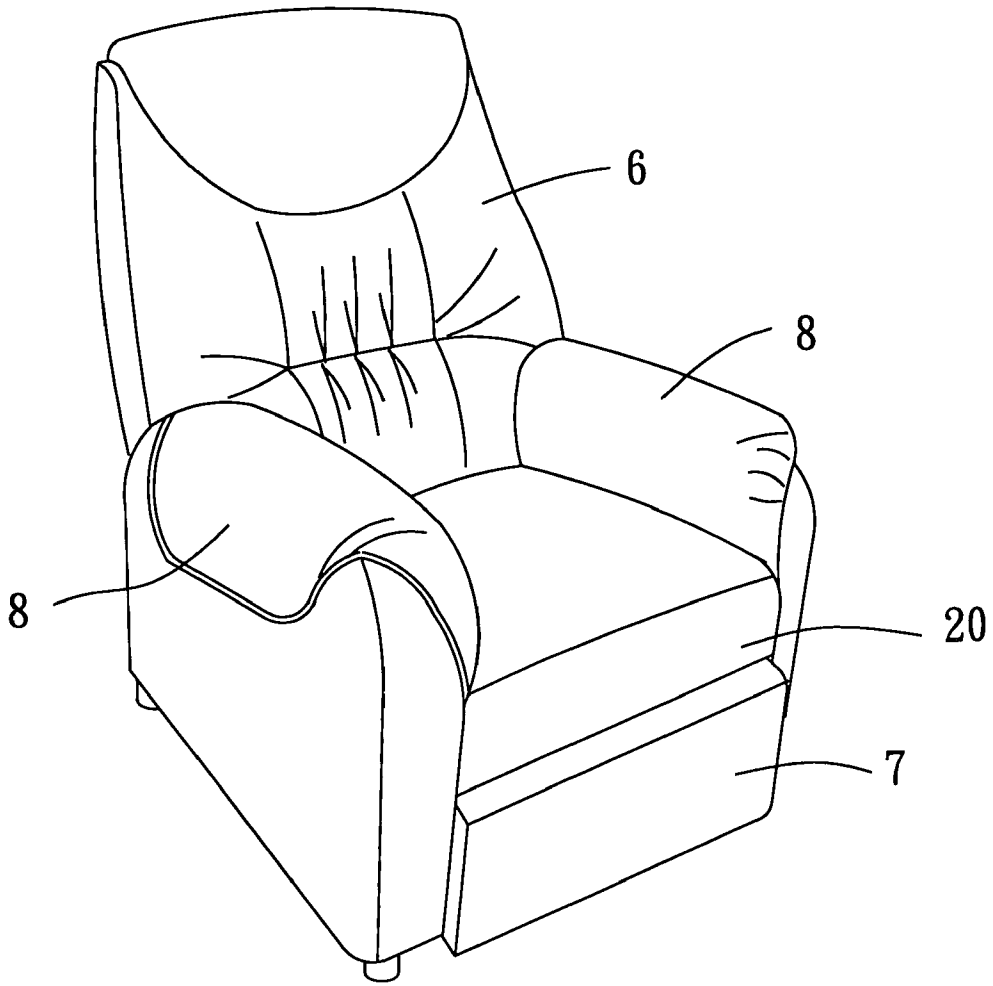
FIG. 3 is a perspective view to illustrate the preferred embodiment of a reclining chair according to the present invention in a normal state.
Figure 4:
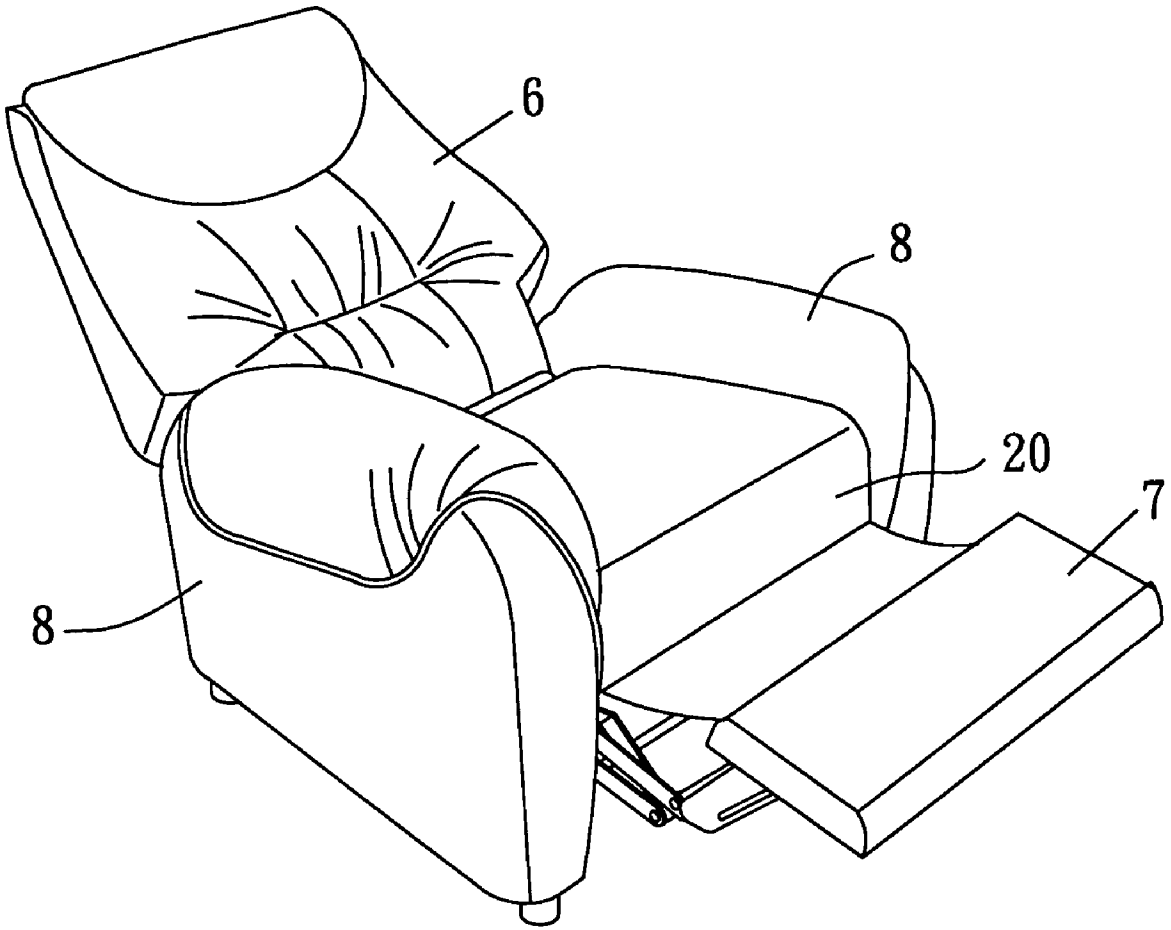
FIG. 4 is a perspective view to illustrate the preferred embodiment in a fully reclined state.
Figure 5:
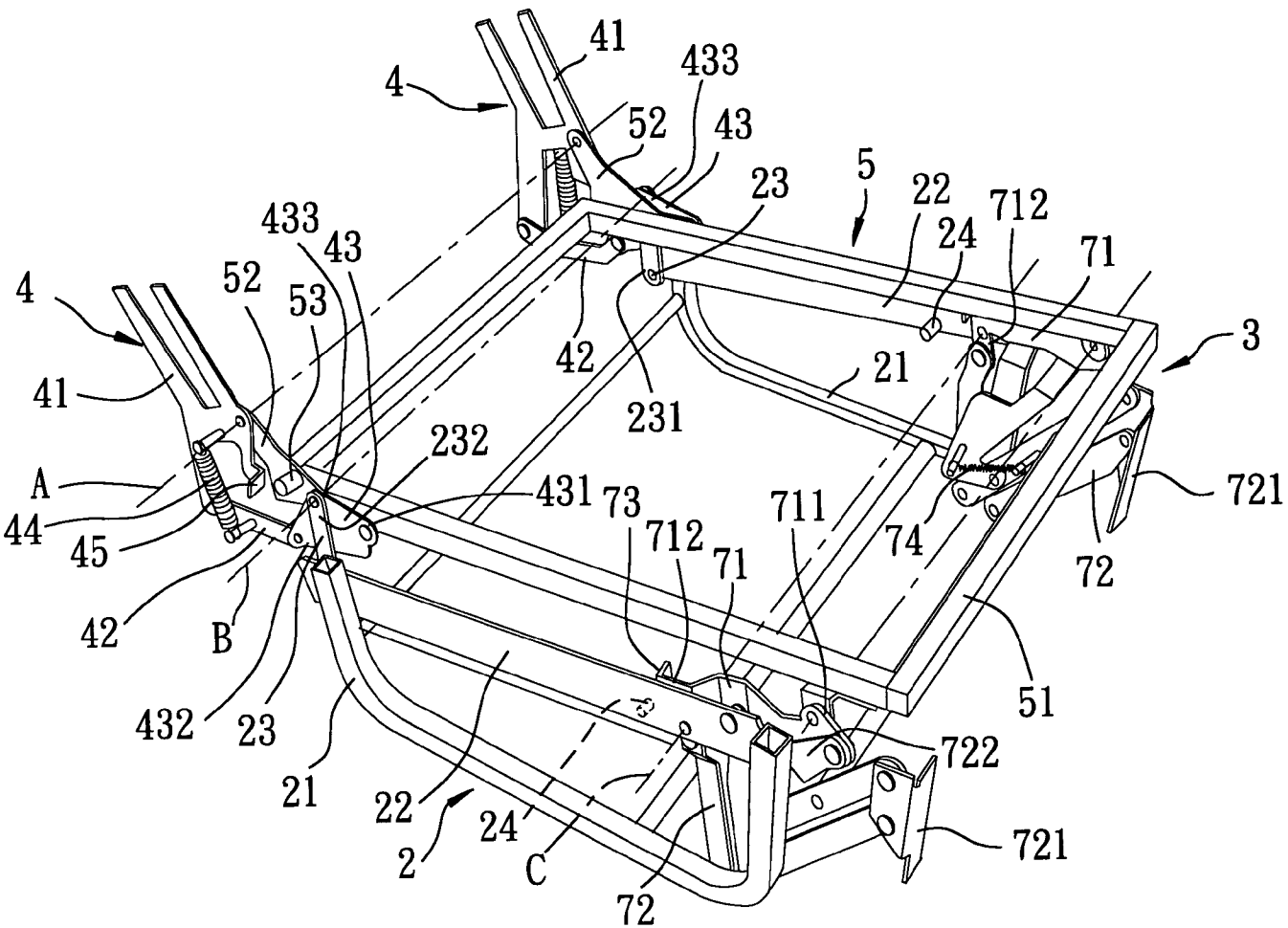
FIG. 5 is a fragmentary perspective view of the preferred embodiment, with upholstery removed therefrom.

Referring to FIGS. 3 and 4, the preferred embodiment of a reclining chair according to the present invention is shown to include an upholstered seat member 20, an upholstered back frame 6, an upholstered leg rest assembly 7, and a pair of upholstered armrest frames 8. In the present invention, the back frame 6 is movable between an upright position shown in FIG. 3 and a tilted position shown in FIG. 4, and the leg rest assembly 7 is movable between a retracted position shown in FIG. 3 and an extended position shown in FIG. 4 without the need for operating a lever mechanism.

FIGS. 5 to 8 illustrate the reclining chair of the preferred embodiment with upholstery removed therefrom for illustrative purposes.

Referring to FIGS. 5 to 8, the reclining chair of the preferred embodiment is shown to comprise a base frame 2, a pair of pivot links 23, the back frame 6, a carriage 5, a pair of linkage mechanisms 4, the leg rest assembly 7, and the armrest frames 8.

The base frame 2 includes left and right upright frame members 21, each of which is U-shaped and has an elongate support arm 22 secured on an inner lateral side thereof.

Each of the pivot links 23 is disposed adjacent to a rear end of the support arm 22 on a respective one of the upright frame members 21, and has a lower pivot end 231 connected pivotally to the support arm 22, and an upper pivot end 232.

The carriage 5 includes a rectangular carriage frame 51, and has the seat member 20 (see FIGS. 3 and 4) mounted thereon.

The linkage mechanisms 4 couple pivotally a lower end of the back frame 6 to a rear end of the carriage frame 51 and the upper pivot ends 232 of the pivot links 23, thereby permitting movement of the back frame 6 from an upright position (see FIG. 6) to a tilted position (see FIG. 7) relative to the carriage frame 51 in response to pressure applied on the back frame 6, and thereby permitting movement of the carriage frame 51 between a front carriage position (see FIGS. 6 and 7) and a rear carriage position (see FIG. 8) relative to the base frame 2.

In this embodiment, each of the linkage mechanisms 4 includes first, second and third link members 41, 42, 43. The first link member 41 is mounted on a respective lateral side of the lower end of the back frame 6, and has a first pivot end 411 connected pivotally to the rear end of a respective lateral side of the carriage frame 51, and a second pivot end 412 disposed rearwardly and below the first pivot end 411. The second link member 42 has a rear pivot end 421 connected pivotally to the second pivot end 412 of the first link member 41, and a front pivot end 422. The third link member 43 is generally triangular in shape, and has a front end 431 connected pivotally to a respective lateral side of the carriage frame 51, a rear end 432 connected pivotally to the front pivot end 422 of the second link member 42, and an intermediate portion 433 between the front and rear ends 431, 432 and connected pivotally to the upper pivot end 232 of the respective pivot link 23.

Preferably, each of the linkage mechanisms 4 further includes an extension spring 44 having opposite ends connected to the first and second link members 41, 42, respectively to provide an assist force to assist in movement of the back frame 6 from the tilted position back to the upright position upon removal of the pressure applied on the back frame 6.

Figure 7:
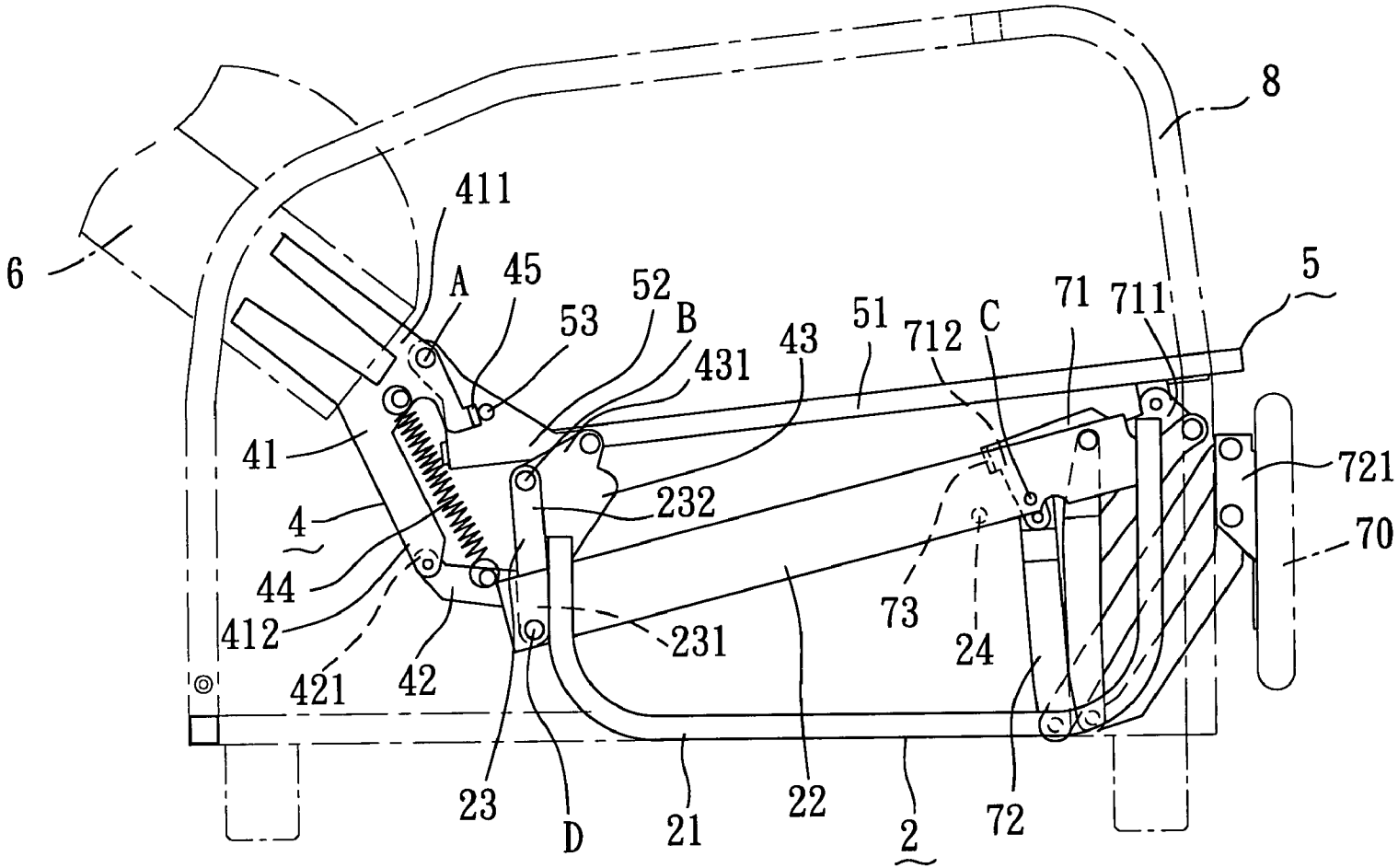
FIG. 7 is a view similar to FIG. 6, illustrating the back frame at a tilted position, the carriage at the front carriage position, and the leg rest assembly at the retracted position.
Figure 8:
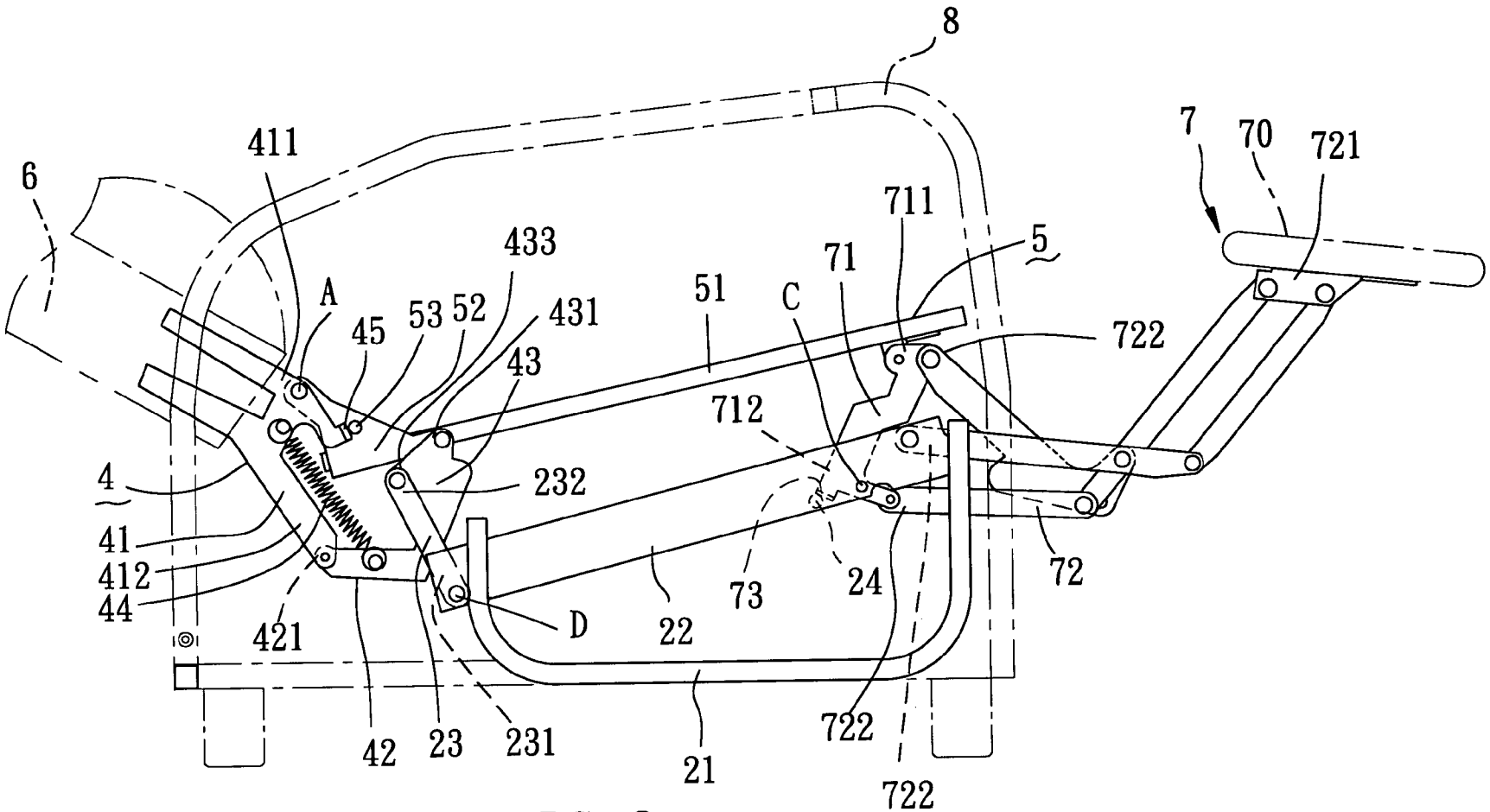
FIG. 8 is a view similar to FIG. 6, illustrating the back frame at the tilted position, the carriage at a rear carriage position, and the leg rest assembly at an extended position.

In this embodiment, two coupling plates 52 are mounted on the rear end of the carriage 5 at the lateral sides of the carriage frame 51, respectively. The first pivot end 411 of the first link member 41 of each of the linkage mechanisms 4 is mounted pivotally on a respective one of the coupling plates 52. A stop projection 53 is formed on each of the coupling plates 52. The first link member 41 of each of the linkage mechanisms 4 is formed with a stop flange 45 that extends from the first pivot end 411 and that abuts against the stop projection 53 on the respective one of the coupling plates 52 when the back frame 6 is at the tilted position, as best shown in FIGS. 7 and 8. Accordingly, the stop projections 53 and the stop flanges 45 constitute a stop unit that is provided on the linkage mechanisms 4 and the rear end of the carriage 5 for positioning the back frame 6 at the tilted position.

The leg rest assembly 7 is connected pivotally to the front end of the carriage frame 51 and to front ends of the support arms 22 on the upright frame members 21 of the base frame 2. The leg rest assembly 7 is driven by the carriage 5 to move from a retracted position (see FIGS. 6 and 7) to an extended position (see FIG. 8) during movement of the carriage 5 from the front carriage position to the rear carriage position.

In this embodiment, the leg rest assembly 7 includes a leg rest member 70, a pair of swing links 71, and a pair of pantograph linkage devices 72. Each of the swing links 71 has a front swing end 711 connected pivotally to the front end of the carriage 5 at a respective lateral side of the carriage frame 51, and a rear swing end 712 connected pivotally to the front end of the support arm 22 on a respective one of the upright frame members 21 of the base frame 2. Each of the pantograph linkage devices 72 is conventional in construction, and has a front coupling end 721 connected to the leg rest member 70, and a rear coupling end 722 connected pivotally to the front and rear swing ends 711, 712 of the respective swing link 71 and to the front end of the support arm 22 on one of the upright frame members 21 of the base frame 2.

Preferably, a second stop unit is provided on the swing links 71 and the support arms 22 of the upright frame members 21 for positioning the leg rest assembly 7 at the extended position. In this embodiment, the second stop unit includes a pair of stop projections 24, each of which is formed on the support arm 22 on a respective one of the upright frame members 21, and a pair of stop flanges 73, each of which extends from the rear swing end 712 of a respective one of the swing links 71 and abuts against a respective one of the stop projections 24 when the leg rest assembly 7 is at the extended position.

Preferably, each of the pantograph linkage devices 72 includes an extension spring 74 for providing an assist force to assist in movement of the leg rest assembly 7 from the extended position back to the retracted position.

The armrest frames 8 are mounted respectively on outer lateral sides of the upright frame members 21 of the base frame 2.

In use, when the back of a person seated on the reclining chair applies pressure on the back frame 6, the first link members 41 of the linkage mechanisms 4 pivot relative to the coupling plates 52 of the carriage 5 about a first pivot axis (A), thereby moving the second link members 42 forwardly and thereby causing the third link members 43 to pivot relative to the pivot links 23 about a second pivot axis (B). Slight upward movement of the rear end of the carriage 5 relative to the base frame 2 occurs at this time due to the pivot connection between the third link members 42 and the carriage frame 51. The stop flanges 45 on the first link members 41 eventually abut against the stop projections 53 on the coupling plates 52 to thereby position the back frame 6 at the tilted position relative to the carriage 5, as best shown in FIG. 7.

Thereafter, when it is desired to extend the leg rest assembly 7, the person on the reclining chair grips the armrest frames 8 while remaining seated on the seat member 20 and while maintaining pressure on the back frame 6, and uses his lower body portion to apply an external force for moving the carriage 5 rearward from the front carriage position to the rear carriage position. At this time, the carriage 5 drives the swing links 71 to pivot about a third pivot axis (C) for actuating the pantograph linkage devices 72 so as to move the leg rest assembly 7 from the retracted position to the extended position, as best shown in FIG. 8. Moreover, because the back frame 6 is positioned at the tilted position by the first stop unit, movement of the carriage 5 to the rear carriage position simultaneously results in rearward pivoting movement of the back frame 6, the linkage mechanisms 4, the carriage 5 and the pivot links 23 about a fourth pivot axis (D) relative to upright frame members 21 of the base frame 2. The stop flanges 73 on the swing links 71 eventually abut against the stop projections 24 on the support arms 22 of the upright frame members 21 to thereby position the leg rest assembly 7 at the extended position, as best shown in FIG. 8.

Figure 6:
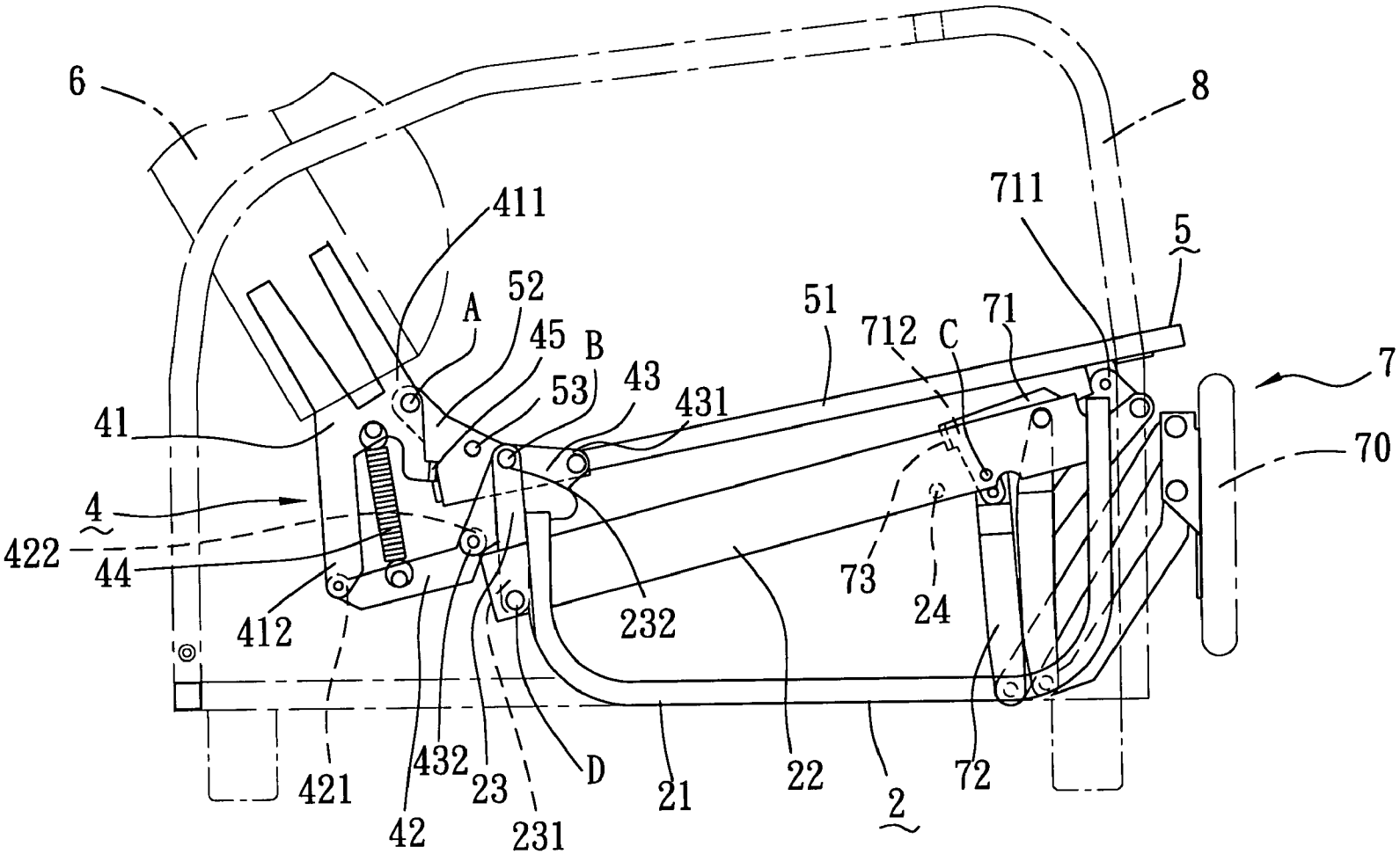
FIG. 6 is a fragmentary schematic side view of the preferred embodiment, illustrating a back frame at an upright position, a carriage at a front carriage position, and a leg rest assembly at a retracted position.

To restore the reclining chair to the state shown in FIG. 6, the person seated on the reclining chair uses his legs to apply pressure on the leg rest member 70 in order to force the leg rest assembly 7 to move to the retracted position. As the leg rest assembly 7 moves to the retracted position, the carriage 5 is pulled by the swing links 71 to move to the front carriage position, and the back frame 6, the linkage mechanisms 4, the carriage 5 and the pivot links 23 pivot forwardly about the fourth pivot axis (D). Thereafter, the back frame 6 can be restored to the upright position with the assistance of the extension springs 44 when the pressure applied on the back frame 6 is removed.

It has thus been shown that a lever mechanism is not required for tilting the back frame 6 and for extending the leg rest assembly 7 in the reclining chair of the present invention. The aforesaid problems associated with the use of the lever mechanism in the conventional reclining chair are accordingly solved.

While the present invention has been described in connection with what is considered the most practical and preferred embodiment, it is understood that this invention is not limited to the disclosed embodiment but is intended to cover various arrangements included within the spirit and scope of the broadest interpretation so as to encompass all such modifications and equivalent arrangements.

I claim:

1. A reclining chair comprising:

a base frame;

a pivot link having a lower pivot end connected pivotally to said base frame, and an upper pivot end;

a back frame having a lower end;

a carriage having front and rear ends;

a linkage mechanism for coupling pivotally said lower end of said back frame to said rear end of said carriage and said upper pivot end of said pivot link, thereby permitting movement of said back frame from an upright position to a tilted position relative to said carriage in response to pressure applied on said back frame and thereby permitting movement of said carriage between front and rear carriage positions relative to said base frame;

a leg rest assembly connected pivotally to said front end of said carriage and said base frame and driven by said carriage to move from a retracted position to an extended position during movement of said carriage from the front carriage position to the rear carriage position; and stop means provided on said linkage mechanism and said rear end of said carriage for positioning said back frame at the tilted position;

wherein, when said back frame is at the tilted position, movement of said carriage from the front carriage position to the rear carriage position due to an external applied force results in movement of said leg rest assembly from the retracted position to the extended position and simultaneously results in rearward pivoting movement of said back frame, said linkage mechanism, said carriage and said pivot link relative to said base frame;

wherein said linkage mechanism includes:

a first link member mounted on said lower end of said back frame and having a first pivot end connected pivotally to said rear end of said carriage, and a second pivot end disposed rearwardly and below said first pivot end;

a second link member having a rear pivot end connected pivotally to said second pivot end of said first link member, and a front pivot end; and a third link member having a front end connected pivotally to said carriage, a rear end connected pivotally to said front pivot end of said second link member, and an intermediate portion connected pivotally to said upper pivot end of said pivot link.

2. The reclining chair as claimed in claim 1, wherein said rear end of said carriage has a coupling plate mounted thereon, said first pivot end of said first link member being mounted pivotally on said coupling plate, said stop means including a stop projection formed on said coupling plate, and a stop flange extending from said first pivot end of said first link member and abutting against said stop projection when said back frame is at the tilted position.

3. The reclining chair as claimed in claim 1, further comprising an extension spring having opposite ends connected to said first and second link members, respectively.

4. The reclining chair as claimed in claim 1, further comprising a pair of arm rest frames mounted respectively on opposite lateral sides of said base frame.

5. A reclining chair comprising:

a base frame;

a pivot link having a lower pivot end connected pivotally to said base frame, and an upper pivot end;

a back frame having a lower end;

a carriage having front and rear ends;

a linkage mechanism for coupling pivotally said lower end of said back frame to said rear end of said carriage and said upper pivot end of said pivot link, thereby permitting movement of said back frame from an upright position to a tilted position relative to said carriage in response to pressure applied on said back frame and thereby permitting movement of said carriage between front and rear carriage positions relative to said base frame;

a leg rest assembly connected pivotally to said front end of said carriage and said base frame and driven by said carriage to move from a retracted position to an extended position during movement of said carriage from the front carriage position to the rear carriage position; and stop means provided on said linkage mechanism and said rear end of said carriage for positioning said back frame at the tilted position;

wherein, when said back frame is at the tilted position, movement of said carriage from the front carriage position to the rear carriage position due to an external applied force results in movement of said leg rest assembly from the retracted position to the extended position and simultaneously results in rearward pivoting movement of said back frame, said linkage mechanism, said carriage and said pivot link relative to said base frame;

wherein said leg rest assembly includes:

a leg rest member;

a swing link having a front swing end connected pivotally to said front end of said carriage, and a rear swing end connected pivotally to said base frame; and a pantograph linkage device having a front coupling end connected to said leg rest member, and a rear coupling end connected pivotally to said front and rear swing ends of said swing link and said base frame;

further comprising second stop means provided on said swing link and said base frame for positioning said leg rest assembly at the extended position.

6. The reclining chair as claimed in claim 5, wherein said second stop means includes a stop projection formed on said base frame, and a stop flange extending from said rear swing end of said swing link and abutting against said stop projection when said leg rest assembly is at the extended position.

7. The reclining chair as claimed in claim 5, further comprising a pair of armrest frames mounted respectively on opposite lateral sides of said base frame.

8. A reclining chair comprising:

a base frame;

a pivot link having a lower pivot end connected pivotally to said base frame, and an upper pivot end;

a back frame having a lower end;

a carriage having front and rear ends;

a linkage mechanism for coupling pivotally said lower end of said back frame to said rear end of said carriage and said upper pivot end of said pivot link, thereby permitting movement of said back frame from an upright position to a tilted position relative to said carriage in response to pressure applied on said back frame and thereby permitting movement of said carriage between front and rear carriage positions relative to said base frame;

a leg rest assembly connected pivotally to said front end of said carriage and said base frame and driven by said carriage to move from a retracted position to an extended position during movement of said carriage from the front carriage position to the rear carriage position; and stop means provided on said linkage mechanism and said rear end of said carriage for positioning said back frame at the tilted position;

wherein, when said back frame is at the tilted position, movement of said carriage from the front carriage position to the rear carriage position due to an external applied force results in movement of said leg rest assembly from the retracted position to the extended position and simultaneously results in rearward pivoting movement of said back frame, said linkage mechanism, said carriage and said pivot link relative to said base frame;

wherein said leg rest assembly includes:

a leg rest member;

a swing link having a front swing end connected pivotally to said front end of said carriage, and a rear swing end connected pivotally to said base frame; and a pantograph linkage device having a front coupling end connected to said leg rest member, and a rear coupling end connected pivotally to said front and rear swing ends of said swing link and said base frame;

wherein said pantograph linkage device includes an extension spring for providing an assist force to assist in movement of said leg rest assembly from the extended position back to the retracted position.

9. The reclining chair as claimed in claim 8, further comprising a pair of arm rest frames mounted respectively on opposite lateral sides of said base frame.

* * * * *